US009631808B2

(12) United States Patent
Taylor et al.

(10) Patent No.: US 9,631,808 B2
(45) Date of Patent: Apr. 25, 2017

(54) FUEL-AIR-FLUE GAS BURNER

(71) Applicant: Honeywell International Inc., Morristown, NJ (US)

(72) Inventors: Curtis Taylor, Gaston, IN (US); Joseph S. F. Goh, Noblesville, IN (US)

(73) Assignee: Honeywell International Inc., Morris Plains, NJ (US)

( * ) Notice: Subject to any disclaimer, the term of this patent is extended or adjusted under 35 U.S.C. 154(b) by 203 days.

(21) Appl. No.: 14/550,302

(22) Filed: Nov. 21, 2014

(65) Prior Publication Data

US 2016/0146455 A1 May 26, 2016

(51) Int. Cl.

| | |
|---|---|
| ***F23C 9/08*** | (2006.01) |
| ***F23C 7/00*** | (2006.01) |
| ***F23M 9/00*** | (2006.01) |
| ***F24H 1/14*** | (2006.01) |
| ***F24H 9/20*** | (2006.01) |
| ***F23M 9/06*** | (2006.01) |
| ***F23D 14/82*** | (2006.01) |

(52) U.S. Cl.

CPC ..... *F23C 9/08* (2013.01); *F23C 7/008* (2013.01); *F23D 14/82* (2013.01); *F23M 9/003* (2013.01); *F23M 9/06* (2013.01); *F24H 1/145* (2013.01); *F24H 9/2035* (2013.01); *F23C 2202/10* (2013.01); *F23C 2202/50* (2013.01); *F23D 2203/1012* (2013.01)

(58) Field of Classification Search

CPC ..... F23C 9/08; F23C 2202/10; F23C 2202/50

See application file for complete search history.

(56) References Cited

U.S. PATENT DOCUMENTS 2,216,809 A * 10/1940 Derby ..... F24H 1/205 122/14.22
3,521,582 A * 7/1970 Liden ..... F24C 3/004 110/147
4,222,350 A * 9/1980 Pompei ..... F24H 1/52 122/32

(Continued)

FOREIGN PATENT DOCUMENTS

| | | |
|---|---|---|
| EP | 428117 | 5/1991 |
| EP | 657689 | 6/1995 |

OTHER PUBLICATIONS

"FIR Burner Forced Internal Recirculation Burner", Johnston Burner Company, www.johnstonboiler.com, 2 pgs. Date Accessed: Mar. 5, 2014.

*Primary Examiner* — Avinash Savani
*Assistant Examiner* — Deepak Deean
(74) *Attorney, Agent, or Firm* — Brooks, Cameron, and Huebsch, PLLC

(57) ABSTRACT

A gaseous fuel-air-flue gas burner is described herein. One device includes a housing having a combustion chamber containing a combustion area in which a combination of fuel, air, and flue gas mix to form a flame, a flame arrester having an outer surface for the flame to form, a supply chamber configured to receive the fuel, air, and flue gas mixture at an inlet and provide the combustion area with the fuel, air, and flue gas mixture at an outlet to produce a flame and a quantity of return flue gas, and a return cavity configured to move return flue gas away from the combustion area and into the inlet of the supply chamber.

17 Claims, 6 Drawing Sheets

(56) References Cited

U.S. PATENT DOCUMENTS 4,479,535 A * 10/1984 Echigo ..... F23C 3/002 126/91 A
4,502,626 A * 3/1985 Gerstmann ..... A61K 51/0476 122/14.3
4,679,528 A * 7/1987 Krans ..... F23D 14/06 122/18.4
RE33,082 E * 10/1989 Gerstmann ..... F24D 11/004 122/20 B
4,993,402 A * 2/1991 Ripka ..... F24H 1/124 122/18.2
4,995,807 A * 2/1991 Rampley ..... F23C 9/00 431/115
5,012,793 A * 5/1991 Guzorek ..... F23J 13/025 126/293
5,171,144 A * 12/1992 Gerstmann ..... F23D 14/36 122/17.1
5,311,843 A * 5/1994 Stuart ..... F24H 1/43 122/18.4
5,350,293 A * 9/1994 Khinkis ..... F23C 6/045 431/116
5,433,174 A 7/1995 Brady et al.
5,462,430 A * 10/1995 Khinkis ..... F23C 3/006 122/17.1
5,516,278 A * 5/1996 Morrison ..... F23D 14/02 122/155.2
5,687,678 A * 11/1997 Suchomel ..... F24H 1/43 122/247
5,713,310 A * 2/1998 Lemke ..... B08B 3/026 122/18.4
6,029,614 A * 2/2000 Kayahara ..... F22B 21/065 122/367.1
6,106,276 A * 8/2000 Sams ..... F23D 14/46 126/110 C
6,152,086 A * 11/2000 Brouwer ..... F23D 14/62 122/249
6,321,743 B1 * 11/2001 Khinkis ..... F23C 3/002 126/91 A
6,401,669 B1 * 6/2002 MacGowan ..... F24H 1/43 122/406.1
6,641,625 B1 * 11/2003 Clawson ..... B01J 8/0419 422/187
6,792,895 B2 * 9/2004 Kayahara ..... F23C 9/08 122/367.3
6,823,821 B2 * 11/2004 Kayahara ..... F23C 9/08 110/234
6,890,172 B2 5/2005 Stephens et al.
7,066,973 B1 * 6/2006 Bentley ..... B01J 8/0465 422/198
7,267,083 B2 * 9/2007 Le Mer ..... F28D 7/024 122/18.1
7,281,497 B2 * 10/2007 Le Mer ..... F24H 1/43 122/18.1
7,302,916 B2 * 12/2007 LeMer ..... F24H 1/43 122/15.1
7,428,883 B2 * 9/2008 Hamada ..... F24H 1/43 122/31.1
7,762,807 B2 * 7/2010 Linck ..... F23C 3/002 126/91 A
7,836,942 B2 * 11/2010 Cannas ..... F24H 1/43 165/163
7,909,005 B2 * 3/2011 Le Mer ..... F24H 1/43 122/18.1
8,402,927 B2 * 3/2013 Home ..... F24H 1/282 122/15.1
9,199,861 B2 * 12/2015 Duesel, Jr. ..... C02F 1/048
9,353,967 B2 * 5/2016 Ahmady ..... F24H 1/18
2001/0031440 A1 * 10/2001 Fullemann ..... F23C 9/006 432/175
2002/0050342 A1 * 5/2002 Gerstmann ..... F22B 7/00 165/109.1
2005/0133202 A1 * 6/2005 Jorgensen ..... F28D 7/024 165/103
2007/0099134 A1 * 5/2007 Hamada ..... F23N 1/022 431/12
2008/0185132 A1 * 8/2008 Cannas ..... F24H 1/43 165/163
2008/0186039 A1 * 8/2008 Cannas ..... F24H 1/43 324/750.28
2012/0000456 A1 * 1/2012 Le Mer ..... F23D 14/62 126/193
2012/0312513 A1 * 12/2012 Le Mer ..... F24H 1/43 165/159
2016/0123583 A1 * 5/2016 Rakette ..... F23L 15/04 431/215

* cited by examiner

FUEL-AIR-FLUE GAS BURNER

BACKGROUND

The present disclosure is related generally to the field of burners. More particularly, the present disclosure is related to fuel-air-flue gas burners.

A typical gas burner can utilize a premixed fuel and air mixture to produce (e.g., generate) a flame for various applications. For example, these fuel-air burner applications may include using a flame to generate heat for use in residential and commercial hot water boiler/heater applications.

These fuel-air burners achieve low emissions by using a larger (e.g., higher) amount of air to generate a lower flame temperature. The lower flame temperature produces less emissions and pollutants that are exhausted into the atmosphere. However, the higher air content which causes the lower flame temperature results in a less than optimal efficiency. Furthermore, the combustion products may be exhausted outside the burner without fully capturing all of the heat energy that is available from the combustion process.

DETAILED DESCRIPTION

Figure 1:
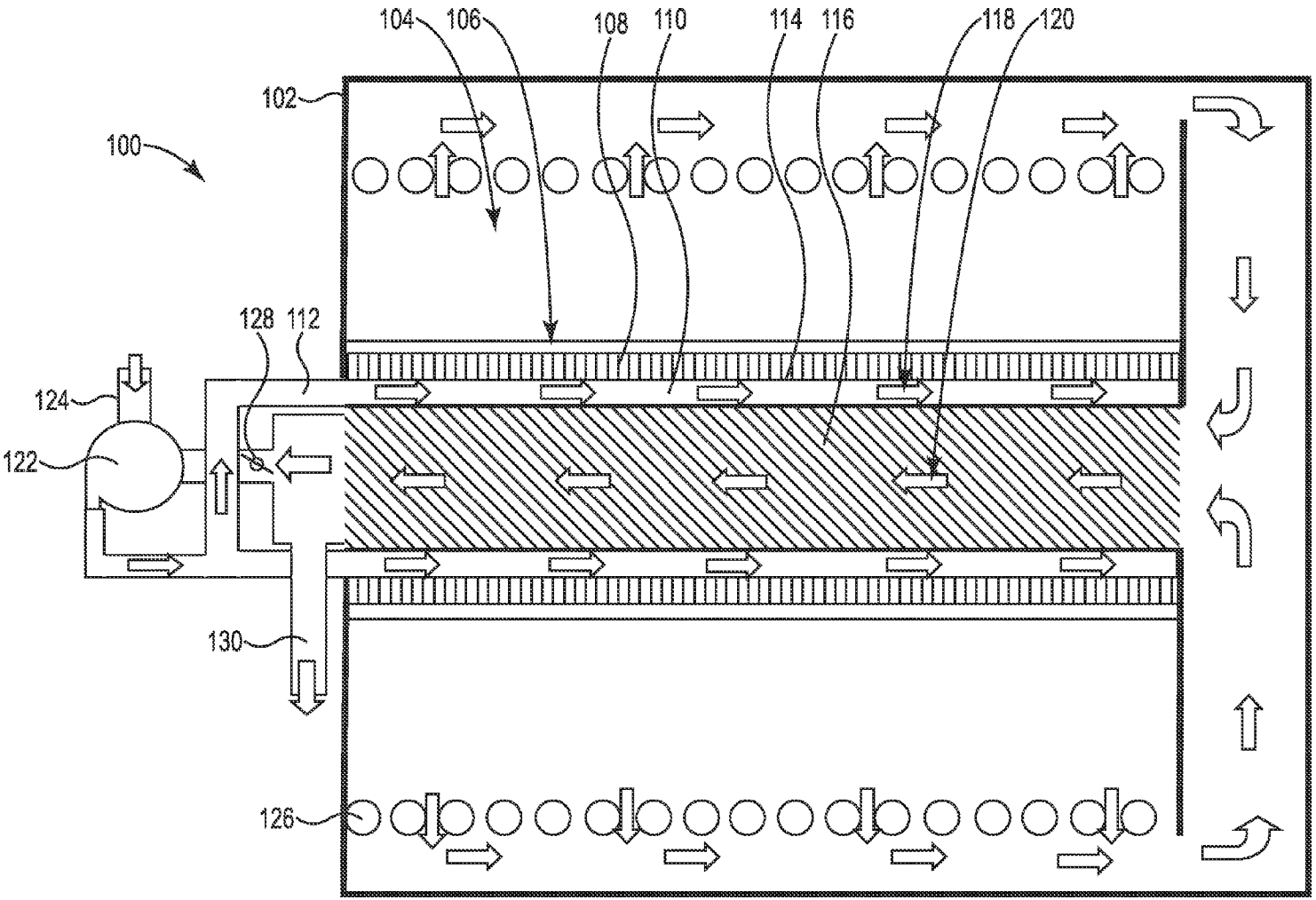
FIG. 1 illustrates a view of a fuel-air-flue gas burner in accordance with one or more embodiments of the present disclosure.

Embodiments of gaseous fuel-air-flue gas burners are described herein. For example, one or more embodiments include a housing having a combustion chamber containing a combustion area in which a combination of fuel, air, and flue gas mix to form a flame, a flame arrester having an outer surface for the flame to form, a supply chamber configured to receive the fuel, air, and flue gas mixture at an inlet and provide the combustion area with the fuel, air, and flue gas mixture at an outlet to produce a flame and a quantity of return flue gas, and a return cavity configured to move return flue gas away from the combustion area and into the inlet of the supply chamber.

Fuel-air-flue gas burner embodiments, in accordance with the present disclosure, may be able to capture more of the heat energy that is available from the combustion process than previous fuel-air burners by recycling return flue gas to extract additional heat that would otherwise be exhausted out of the burner without being utilized. Accordingly, fuel-air-flue gas burners in accordance with the present disclosure may be more efficient while still meeting emissions standards (e.g., standards set by a government or company).

Current applications for the fuel-air-flue gas burner can include applications for residential heating. For example, the fuel-air-flue gas burner can be used for heating water used in the heating of a residential home. Additionally, the fuel-air-flue gas burner can be used in residential domestic hot water applications such as heating water for bathing or washing clothing.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits.

As used herein, "a" or "a number of" something can refer to one or more such things. For example, "a number of valves" can refer to one or more valves.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

FIG. 1 illustrates a view of a fuel-air-flue gas burner in accordance with one or more embodiments of the present disclosure. As shown in the embodiment of FIG. 1, fuel-air-flue gas burner 100 can include a housing 102 containing a combustion chamber 104. Combustion chamber 104 can contain a combustion area 106 in which a fuel-air-flue gas mixture 118 combusts to form a flame. Combustion area 106 forms on the outer surface of a flame arrester 108.

Supply chamber 110 can receive a fuel-air-flue gas mixture 118 at supply chamber inlet 112, and provide fuel-air-flue gas mixture 118 to supply chamber outlet 114. Supply chamber outlet 114 can provide fuel-air-flue gas mixture 118 to flame arrester 108. Flame arrester 108 can provide fuel-air-flue gas mixture 118 to the combustion area 106, where the fuel-air-flue gas mixture 118 is ignited to form a flame.

Supply chamber outlet 114 can include openings adjacent to flame arrester 108 in order to supply fuel-air-flue gas mixture 118 to flame arrester 108. Such openings can, for example, be radial, or other shaped openings along the outer surface of supply chamber outlet 114. Examples of suitable supply chamber outlet configurations 114 can include ports, slots, perforations, or other openings of varying size to supply fuel-air-flue gas mixture 118 to flame arrester 108.

In some embodiments, flame arrester 108 can be manufactured, for example, out of a fibrous material that allows fuel-air-flue gas mixture 118 to pass through to combustion area 106 to form a flame on the outer surface of flame arrester 108, but not allow products of combustion area 106 (e.g., flames) to re-enter supply chamber 110, preventing flashback and/or explosions, among other issues.

Combustion area 106 forms on the outer surface of flame arrester 108. Supply chamber outlet 114 can supply the combustion area 106 in such a way that combustion area 106 forms in a uniform annular flame distribution about the outer surface of flame arrester 108.

The combustion area 106 can produce a quantity of return flue gas 120 that contains heat energy. After combustion, the quantity of return flue gas 120 can move away from the combustion area 106 in a radial direction. As shown in FIG. 1, quantity of return flue gas 120 is forced to pass by helical coil 126 as it moves toward return cavity 116.

In an embodiment of the present disclosure, return flue gas 120 can be comprised of a number of products in a number of quantities. These products can include, for example, carbon dioxide, water vapor, nitric oxides, and carbon monoxide.

In various embodiments, helical coil 126 can be a continuous, helical tube containing a heat transfer media such as water. The water can be ordinary tap water, or water containing a various mixture of chemicals. Such chemical mixtures can, for example, function to inhibit corrosion or the growth of mold or bacteria, enhance heat transfer, or provide other benefits. However, embodiments of the present disclosure are not limited to a particular type of media within helical coil 126.

During the combustion process, helical coil 126 can absorb heat energy through various heat transfer mechanisms. For example, the combustion process at combustion area 106 can release radiant heat that is absorbed by the water inside helical coil 126. Additionally, helical coil 126 can also absorb heat through convection as return flue gas 120 moves past helical coil 126.

Once return flue gas 120 has passed between the coil portions of the helical coil 126, it is drawn into return cavity 116. Return cavity 116 is located within supply chamber 110 such that return flue gas 120 does not mix with fuel-air-flue gas mixture 118.

Once inside return cavity 116, return flue gas 120 can transfer additional residual heat not lost to helical coil 126 to fuel-air-flue gas mixture 118 located within supply chamber 110. For example, return flue gas 120 can transfer heat to fuel-air-flue gas mixture 118 through convective and conductive heat transfer mechanisms, as will further be described herein.

In some embodiments, after return flue gas 120 passes through a return cavity 116, it can be recycled back into supply chamber 110 via a control valve 128. Control valve 128 can regulate (e.g., adjust) the appropriate amount of return flue gas 120 to be recycled back into supply chamber 110.

An appropriate amount of return flue gas 120 to be recycled can be determined by the oxygen content in the outside air and gas mixture drawn in to blower assembly 122 through combustion intake 124. For example, a typical oxygen content in the outside air and gas mixture can be between 17-20%. Additionally, an appropriate amount of return flue gas to be recycled can be 10-20% of the total volume of flue gas produced by the combustion.

The amount of recycled flue gas 120 can be adjusted based on the proportion of the amount of oxygen contained in the outside air and the recycled gas mix. For example, if more oxygen is contained in the outside air and gas mix, more return flue gas 120 can be recycled in to blower assembly 122. Non-recycled flue gas is exhausted outside of the burner via exhaust pipe 130.

A blower assembly 122 can receive an appropriate amount of return flue gas 120 that has been recycled and mix the appropriate amount of return flue gas 120 with the outside air and gas mixture to produce fuel-air-flue gas mixture 118. Blower assembly 122 can then supply fuel-air-flue gas mixture 118 to combustion area 106 via supply chamber inlet 112 to continue the combustion cycle.

In another embodiment of the present disclosure, one device includes a gaseous-fuel-air-flue gas burner, comprising a housing having a combustion chamber therein. Within the combustion chamber there is included a combustion area within which a combination of fuel, air, and flue gas mix to form a flame.

The flame occurs on an outer surface of a flame arrester, the flame arrester surrounding a supply chamber. The supply chamber is configured to receive a fuel, air, and flue gas mixture at the supply chamber inlet, and provide a combustion area the fuel, air, and flue gas mixture at the supply chamber outlet via the flame arrester to produce a flame and a quantity of return flue gas. Further within the supply chamber is a return cavity, configured to move return flue gas away from the combustion area and into the supply chamber inlet.

Figure 2:
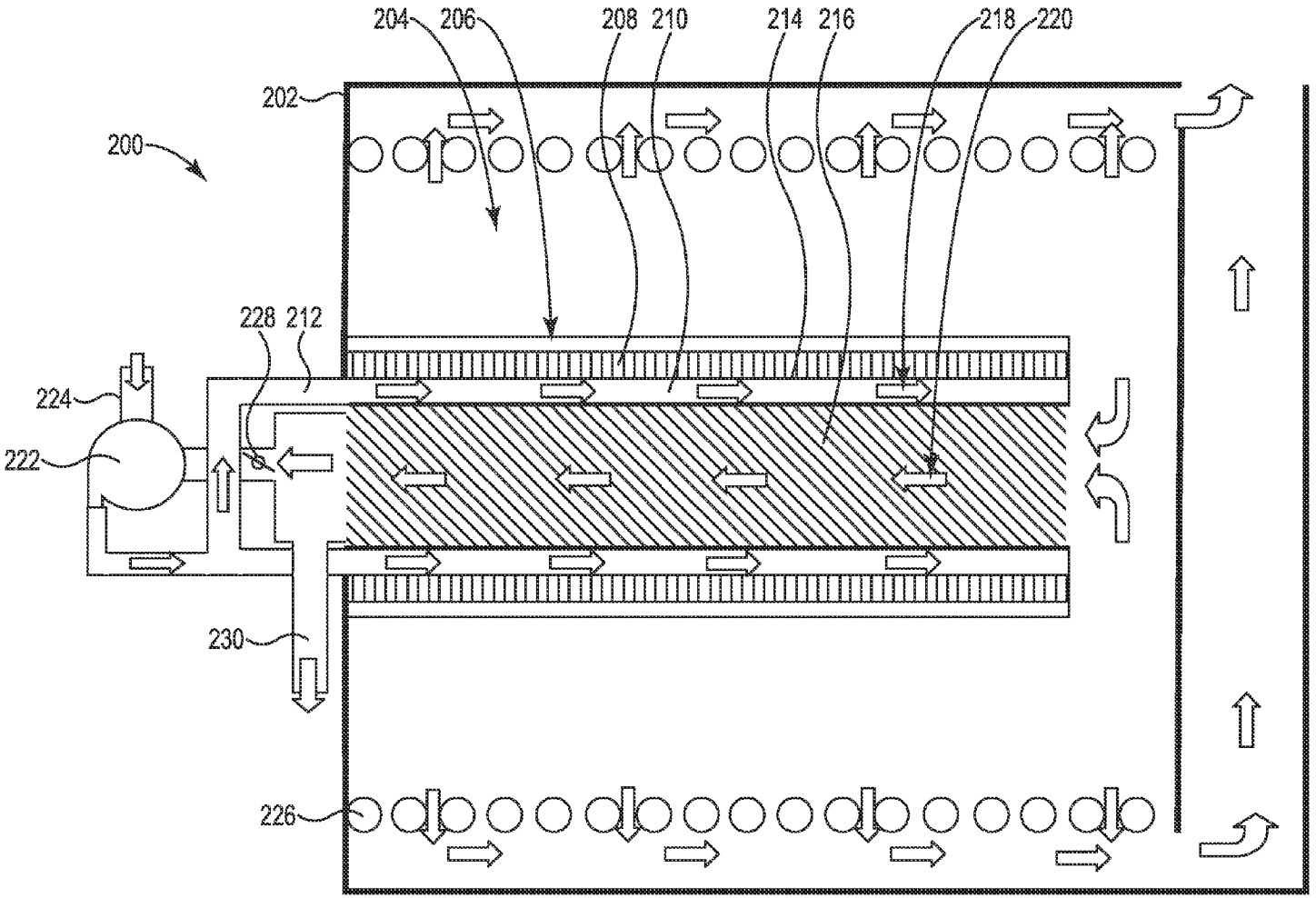
FIG. 2 illustrates a view of a fuel-air-flue gas burner in accordance with one or more embodiments of the present disclosure.

FIG. 2 illustrates a view of a fuel-air-flue gas burner in accordance with one or more embodiments of the present disclosure. As shown in the embodiment of FIG. 2, fuel-air-flue gas burner 200 can include a housing 202 containing a combustion chamber 204. Combustion chamber 204 can contain a combustion area 206 in which a fuel-air-flue gas mixture 218 combusts to form a flame. Combustion area 206 forms on the outer surface of a flame arrester 208.

Similar to the embodiment of FIG. 1, the fuel-air-flue gas burner 200 contains a supply chamber 210 which supplies fuel-air-flue gas mixture 218 to combustion area 206 via flame arrester 208. Additionally, fuel-air-flue gas burner 200 contains helical coil 226, blower assembly 222, control valve 228, and return cavity 216.

The combustion area 206 can produce a quantity of return flue gas 220 that contains heat energy. After combustion, the quantity of return flue gas 220 can move away from combustion area 206 in a radial direction. As shown in FIG. 2, the quantity of return flue gas 220 can pass between the coil portions of the helical coil 226. However, return flue gas 220 can also pass into return cavity 216 without passing between the coil portions of the helical coil 226.

During the combustion process, helical coil 226 can absorb heat energy through various heat transfer mechanisms. For example, the combustion process at combustion area 206 can release radiant heat that is absorbed by the water inside helical coil 226. Additionally, helical coil 226 can also absorb heat through convection as return flue gas 220 moves past helical coil 226.

Return cavity 216 is located within supply chamber 210 such that return flue gas 220 does not mix with fuel-air-flue gas mixture 218. Once inside return cavity 216, return flue gas 220 can transfer heat not lost to helical coil 226 to fuel-air-flue gas mixture 218 located within supply chamber 210. For example, return flue gas 220 can transfer heat to fuel-air-flue gas mixture 218 through convective and conductive heat transfer mechanisms, as will further be described herein.

Similar to the embodiment of FIG. 1, after return flue gas 220 passes through return cavity 216, an appropriate amount can be recycled back into supply chamber 210 via control valve 228. Blower assembly 222 can receive an appropriate amount of return flue gas 220 that has been recycled, and mix the appropriate amount of return flue gas 220 with the outside air and gas mixture drawn in to blower assembly 222 by combustion intake 224 to produce fuel-air-flue gas mixture 218. Fuel-air-flue gas mixture 218 can be supplied to combustion area 206 via supply chamber inlet 212 to continue the combustion cycle. Finally, non-recycled flue gas is exhausted outside of the burner via exhaust pipe 230.

In another embodiment of the present disclosure, the device includes a gaseous-fuel-air-flue gas burner, comprising a housing having a combustion chamber therein. Within the combustion chamber there is included a combustion area within which a combination of fuel, air, and flue gas mix to form a flame. The flame occurs on an outer surface of a flame arrester, the flame arrester surrounding a supply chamber. The supply chamber is configured to receive the fuel, air, and flue gas mixture at the supply chamber inlet, and provide the combustion area the fuel, air, and flue gas mixture at the supply chamber outlet via the flame arrester to produce a flame and a quantity of return flue gas. Further within the supply chamber is a return cavity, configured to move return flue gas away from the combustion area and into the supply chamber inlet.

Figure 3:
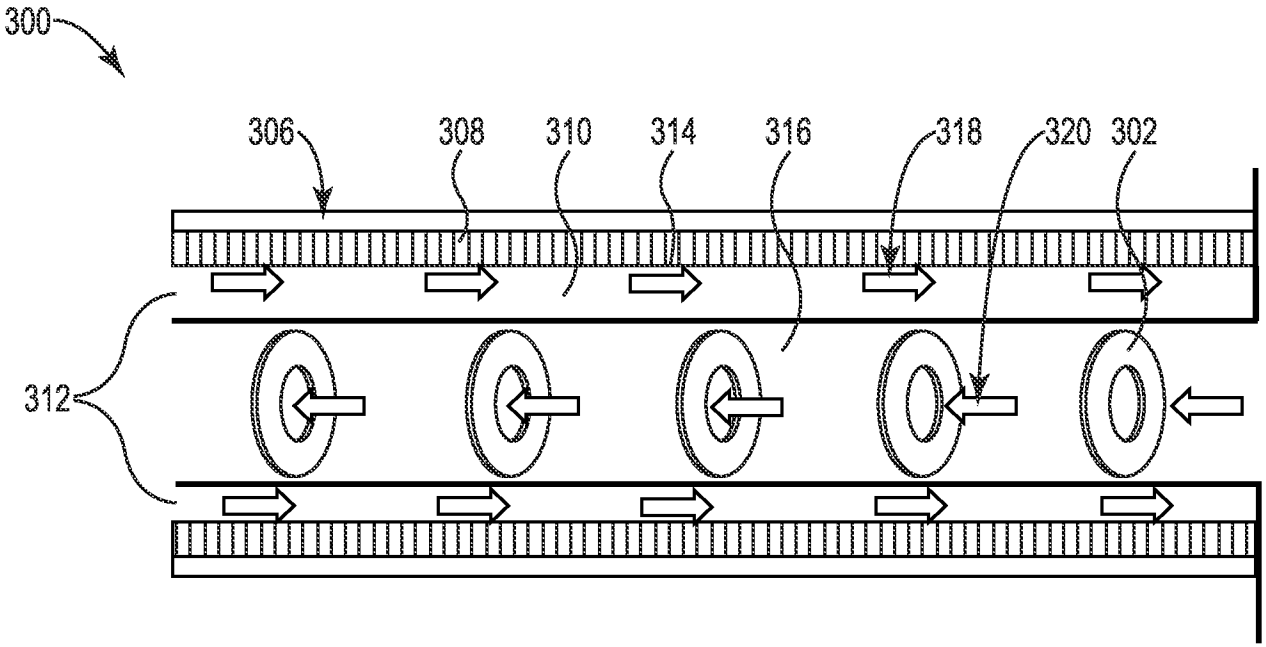
FIG. 3 illustrates a view of a portion of a supply chamber and return cavity in accordance with one or more embodiments of the present disclosure.

FIG. 3 illustrates a view of a portion of a supply chamber and return cavity in accordance with one or more embodiments of the present disclosure. As shown in the embodiment of FIG. 3, fuel-air-flue gas burner can contain, within return cavity 316, turbulators 302 which disrupt the laminar flow of return flue gas 320.

Turbulators 302 cause the laminar flow of return flue gas 320 to become turbulent. The turbulent flow caused by turbulators 302 within return cavity 316 allows for more of return flue gas 320 to interact with the surface of the return cavity wall. Additionally, the turbulence allows return flue gas 320 to remain in return cavity 316 for a longer period of time. The higher amount of return flue gas 320 interacting with the return cavity wall along with the increase in the amount of surface area return flue gas 320 interacts with allows for a greater amount of heat to transfer from return flue gas 320 to fuel-air-flue gas mixture 318 inside supply chamber 310.

In an embodiment of the present disclosure, turbulator 302 can include a disc with a centralized hole allowing the flow of return flue gas 320 to pass through while also causing the flow of return flue gas 320 to become turbulent. In some embodiments, turbulator 302 can be attached (e.g., welded, mechanically affixed) to the wall of return cavity 316 to provide a conduction path for heat from return flue gas 320 to pass to fuel-air-flue gas mixture 318 in supply chamber 310. In some embodiments, turbulator 302 is attached to the wall of return cavity 316 at all points around the disc. A number of turbulators 302 (e.g., more than one) can be included within return cavity 316. The number of turbulators can depend on the length of return cavity 316, the flow rates of return flue gas 320 and fuel-air-flue gas mixture 318, the efficiency of fuel-air-flue gas burner 300, or other factors that may affect the use of turbulators in the device.

In another embodiment, turbulator 302 can include a star shape allowing the flow of return flue gas 320 to pass around the star while also causing the flow of return flue gas 320 to become turbulent. In some embodiments, turbulator 302 can be attached to the wall of return cavity 316 at the points of the star, providing conduction paths for the heat from return flue gas 320 to pass to the fuel-air-flue gas mixture 318 in supply chamber 310.

In various other embodiments, turbulator 302 can be of any shape that would trip the flow of return flue gas 320 from laminar to turbulent. Further, turbulator 302 can be of any shape that would allow a path for conduction for the heat from return flue gas 320 to pass to the fuel-air-flue gas mixture 318 in supply chamber 310.

In an embodiment of the present disclosure, turbulator 302 can be manufactured from a material that has a high thermal conductivity. For example, turbulator 302 can be manufactured out of a material such as metal to promote the transfer of heat from return flue gas 320 to fuel-air-flue gas mixture 318. Turbulator 302 is connected to the wall of return cavity 316 so as to provide a conduction path from turbulator 302 to the wall of return cavity such that the heat of return flue gas 320 is transferred to fuel-air-flue gas mixture 318 that is moving to the combustion area 306 via the supply chamber inlet 312, supply chamber outlet 314, and flame arrester 308. For example, turbulator 302 can be welded to the wall of return cavity 316.

Figure 4:
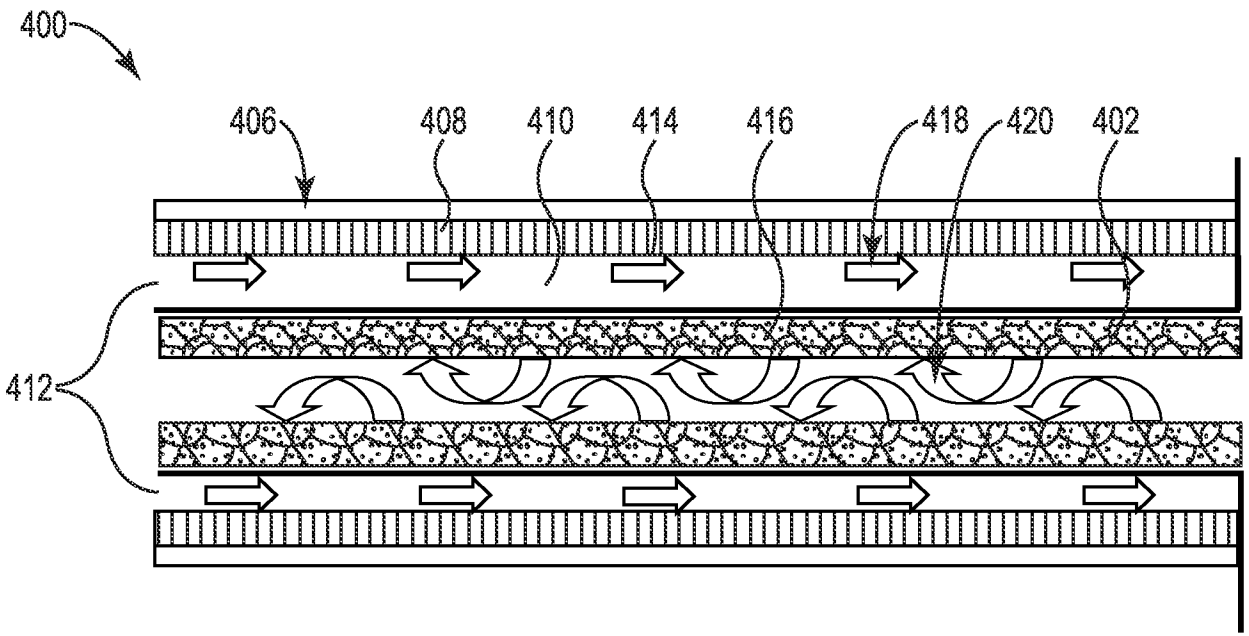
FIG. 4 illustrates a view of a portion of a supply chamber and return cavity in accordance with one or more embodiments of the present disclosure.

FIG. 4 illustrates a view of a portion of a supply chamber and return cavity in accordance with one or more embodiments of the present disclosure. As shown in the embodiment of FIG. 4, fuel-air-flue gas burner can contain, within return cavity 416, porous media 402 which disrupts the laminar flow of return flue gas 420.

Similar to the embodiment of FIG. 3, porous media 402 causes the laminar flow of return flue gas 420 to become turbulent. The turbulent flow caused by porous media 402 within return cavity 416 allows for more of return flue gas 420 to interact with the surface of the return cavity wall. Additionally, the turbulence allows return flue gas 420 to remain in return cavity 416 for a longer period of time. The higher amount of return flue gas 420 interacting with the return cavity wall along with the increase in the amount of surface area return flue gas 420 interacts with allows for a greater amount of heat to transfer from return flue gas 420 to fuel-air-flue gas mixture 418 inside supply chamber 410.

In an embodiment of the present disclosure, porous media 402 can include a ceramic material that causes the laminar flow of return flue gas 420 to become turbulent. Porous media 402 can cover the entirety of the wall of return cavity 416 to provide a conduction path for heat from return flue gas 420 to pass to fuel-air-flue gas mixture 418 in supply chamber 410.

In an embodiment of the present disclosure, porous media 402 can be manufactured from a material that has a high thermal conductivity. For example, porous media 402 can be manufactured out of a material such as a porous "spongy" ceramic to promote heat transfer from return flue gas 420 to fuel-air-flue gas mixture 418. Porous media 402 can be connected to the wall of return cavity 416 so as to provide a conduction path from porous media 402 to the wall of return cavity 416 such that the heat of return flue gas 420 is transferred to fuel-air-flue gas mixture 418 that is moving to the combustion area 406 via the supply chamber inlet 412, supply chamber outlet 414, and flame arrester 408.

Figure 5:
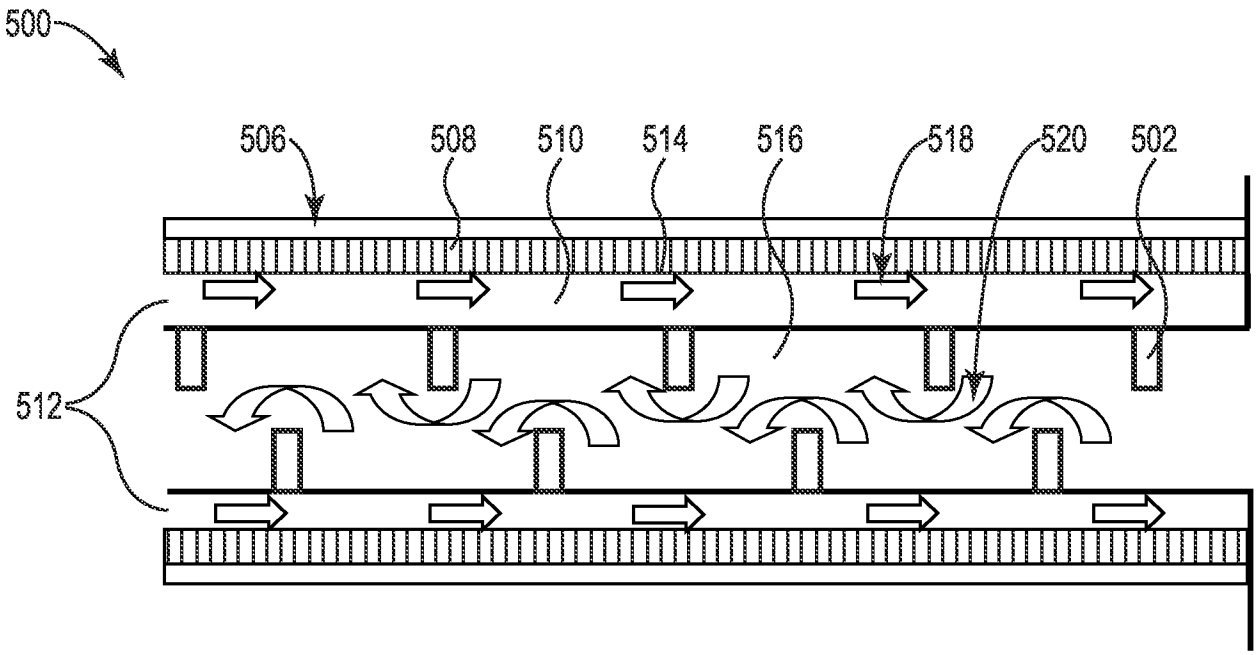
FIG. 5 illustrates a view of a portion of a supply chamber and return cavity in accordance with one or more embodiments of the present disclosure.

FIG. 5 illustrates a view of a portion of a supply chamber and return cavity in accordance with one or more embodiments of the present disclosure. As shown in the embodiment of FIG. 5, fuel-air-flue gas burner can contain, within return cavity 516, turbulators 502 which disrupt the laminar flow of return flue gas 520.

Similar to the embodiment of FIG. 3, turbulators 502 cause the laminar flow of return flue gas 520 to become turbulent. The turbulent flow caused by turbulators 502 within return cavity 516 allows for more of return flue gas 120 to interact with the surface of the return cavity wall. Additionally, the turbulence allows return flue gas 520 to remain in return cavity 516 for a longer period of time. The higher amount of return flue gas 520 interacting with the return cavity wall along with the increase in the amount of surface area the return flue gas 520 interacts with allows for a greater amount of heat to transfer from return flue gas 520 to fuel-air-flue gas mixture 518 inside supply chamber 510.

In an embodiment of the present disclosure, turbulator 502 can include a solid half-disc covering half of the flow path through return cavity 516. Turbulator 502 can be attached (e.g., welded, mechanically affixed) to the wall of return cavity 516 to provide a conduction path for return flue gas 520 to pass to fuel-air-flue gas mixture 518 in supply chamber 510. In some embodiments, turbulator 502 is attached to the wall of return cavity 516 at all points around the half-disc.

In an embodiment of the present disclosure, turbulator 502 can be manufactured from a material that has a high thermal conductivity. For example, turbulator 502 can be manufactured out of a material such as metal to promote the transfer of heat from return flue gas 520 to fuel-air-flue gas mixture 518. Turbulator 502 is connected to the wall of return cavity 516 so as to provide a conduction path from turbulator 502 to the wall of return cavity such that the heat of return flue gas 520 is transferred to fuel-air-flue gas mixture 518 that is moving to the combustion area 506 via the supply chamber inlet 512, supply chamber outlet 514, and flame arrester 508. For example, turbulator 502 can be welded to the wall of return cavity 516.

Turbulator 502 can be arranged in various patterns through the length of return cavity 516. In one embodiment, turbulator 502 can be attached at two sides of return cavity 516 (e.g., 9 O'clock and 3 O'clock), covering the upper half of return cavity 516. Another turbulator 502 can be attached, further downstream within return cavity 516, at two sides of return cavity 516 (e.g., 9 O'clock and 3 O'clock), covering the lower half of return cavity 516. This pattern is repeated through the length of return cavity 516, causing return flue gas 520 to flow in an up-and-down S-pattern.

In another embodiment, turbulator 502 can be attached at two sides of return cavity 516 (e.g., 12 O'clock and 6 O'clock), covering one side-half of return cavity 516. Another turbulator 502 can be attached, further downstream within return cavity 516, at two sides of return cavity 516 (e.g., 12 O'clock and 6 O'clock), covering the other side-half of return cavity 516. This pattern is repeated through the length of return cavity 516, causing return flue gas 520 to flow in a side-to-side S-pattern.

In another embodiment, turbulator 502 can be attached at two sides of return cavity 516 (e.g., 9 O'clock and 3 O'clock), covering the upper half of return cavity 516. A second turbulator 502 can be attached further downstream at two sides of return cavity 516 (e.g., 12 O'clock and 6 O'clock), covering one side-half of return cavity 516. A third turbulator 502 can be attached further downstream at two sides of return cavity 516 (e.g., 9 O'clock and 3 O'clock), covering the lower half of return cavity 516. A fourth turbulator 502 can be attached further downstream at two sides of return cavity 516 (e.g., 12 O'clock and 6 O'clock), covering the other side-half of return cavity 516. This pattern is repeated through the length of return cavity 516, causing return flue gas 520 to flow in a twisting, circular pattern.

Figure 6:
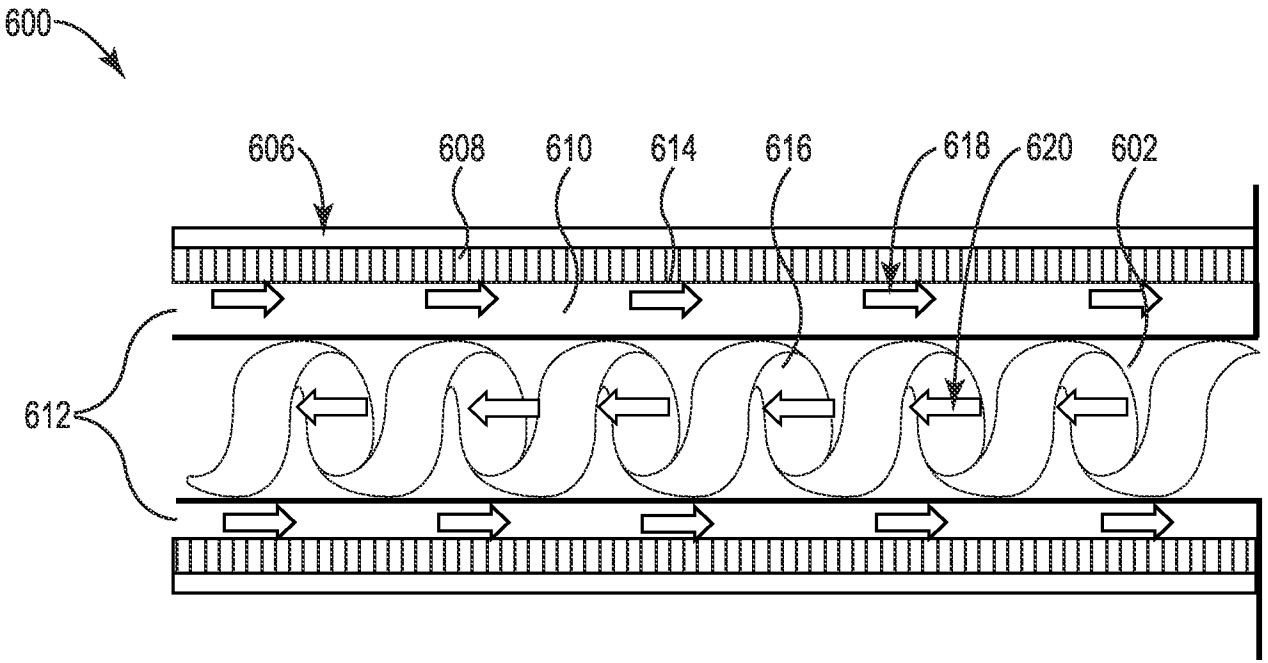
FIG. 6 illustrates a view of a portion of a supply chamber and return cavity in accordance with one or more embodiments of the present disclosure.

FIG. 6 illustrates a view of a portion of a supply chamber and return cavity in accordance with one or more embodiments of the present disclosure. As shown in the embodiment of FIG. 6, return cavity 616 can contain a turbulent flow of return flue gas 620.

The turbulent flows, as further described herein, cause the return flue gas 620 to remain in the return cavity 616 for a longer period of time. Consequently, the flow conducts more heat into the supply chamber 610, allowing for more heat to be transferred to fuel-air-flue gas mixture 618 that is moving to the combustion area 606 via the supply chamber inlet 612, supply chamber outlet 614, and flame arrester 608.

In one embodiment, the movement of return flue gas 620 is illustrated by movement of flow 602 through return cavity 616. Movement of flow 602 can be defined by an up-and-down S-pattern, caused by spaced apart turbulators 602 covering the upper and lower half of return cavity 616.

In another embodiment, the movement of return flue gas 620 is illustrated by movement of flow 602 through return cavity 616. Movement of flow 602 can be defined by a side-to-side S-pattern, caused by spaced apart turbulators 602 covering one side-half and another side-half of return cavity 616.

In another embodiment, the movement of return flue gas 620 is illustrated by movement of flow 602 through return cavity 616. Movement of flow 602 can be defined by a combination of an up-and-down and side-to-side pattern, caused by spaced apart turbulators 602 covering the upper half of return cavity 616, one side half of return cavity 616, the lower half of return cavity 616, and the other side-half of return cavity 616, resulting in a twisting circular flow.

Benefits of the embodiments of the fuel-air-flue gas burner as described herein include the ability to capture more heat energy from the combustion process. Additionally, fuel-air-flue gas burners in accordance with the present disclosure may achieve a higher efficiency than previous fuel-air burners, while still meeting emissions standards.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A gaseous fuel-air-flue gas burner, comprising:

a housing having a combustion chamber therein;

a combustion area in which a combination of fuel, air, and flue gas mix to form a flame within the combustion chamber;

a flame arrester having an outer surface for the flame to form, wherein the combustion area forms on the outer surface of the flame arrester;

a supply chamber configured to receive the fuel, air, and flue gas mixture at an inlet, and provide the combustion area with the fuel, air, and flue gas mixture at an outlet to produce a flame and a quantity of return flue gas, wherein the supply chamber is surrounded by the flame arrester; and a return cavity configured to move return flue gas away from the combustion area and into the inlet of the supply chamber, wherein the return cavity is surrounded by the supply chamber.

2. The gaseous fuel-air-flue gas burner of claim 1, wherein the supply chamber includes an opening adjacent to the flame arrester.

3. The gaseous fuel-air-flue gas burner of claim 2, wherein the flame arrester includes an opening adjacent to the combustion area to provide the combustion area with the fuel, air, and flue gas mixture such that the flame is prevented from re-entering the supply chamber.

4. The gaseous fuel-air-flue gas burner of claim 1, wherein the supply chamber is configured to provide the combustion area with the fuel-oxygen-flue gas mixture in an annular distribution about the flame arrester.

5. The gaseous fuel-air-flue gas burner of claim 1, wherein the return cavity is configured to receive the return flue gas after the return flue gas moves through the combustion chamber.

6. A system for a gaseous fuel-air-flue gas burner, comprising:

a housing having a combustion chamber therein;

a combustion area in which a fuel, air, and flue gas mixture is ignited to form a flame;

a flame arrester having an outer surface for the flame to form;

a blower assembly providing a fuel, air, and flue gas mixture to a supply chamber that is surrounded by the flame arrester, wherein:

the blower assembly is configured to supply an outside air and gas mixture via a combustion intake;

the blower assembly is configured to receive flue gas from a return cavity that is surrounded by the supply chamber; and the blower assembly mixes the outside air and gas mixture with the return flue gas to supply the fuel, air, and flue gas mixture to the supply chamber.

7. The system of claim 6, wherein the combustion chamber contains a helical coil.

8. The system of claim 7, wherein the helical coil contains water.

9. The system of claim 6, wherein the combustion area in which a fuel, air, and flue gas mixture is ignited to form a flame produces the return flue gas that transfers heat to the water inside the helical coil via convective heat transfer.

10. The system of claim 6, wherein the return flue gas is directed into the return cavity via the blower assembly.

11. The system of claim 10, wherein the return cavity is adjacent to the supply chamber to allow the heat from the return flue gas in the return cavity to transfer to the fuel, air, and flue gas mixture in the supply chamber.

12. The system of claim 6, wherein some of the return flue gas in the return cavity is recycled back into the blower assembly and some of the return flue gas is exhausted out of the system via an exhaust port.

13. A gaseous fuel-air-flue gas burner, comprising:

a housing having a combustion chamber therein;

a combustion area in which a combination of fuel, air, and flue gas mix to form a flame within the combustion chamber;

a flame arrester having an outer surface for the flame to form, wherein the combustion area forms on the outer surface of the flame arrester;

a supply chamber surrounded by the flame arrester and configured to provide the combustion area with the fuel, air, and flue gas mixture to produce the flame and a quantity of return flue gas;

a return cavity surrounded by the supply chamber and configured to move the return flue gas away from the combustion area and into the supply chamber;

a control valve that regulates an amount of the return flue gas to be recycled with an outside air and gas mixture in a blower assembly; and an exhaust pipe configured to move the return flue gas not recycled with the outside air and gas mixture in the blower assembly via the control valve outside the fuel-air-flue gas burner.

14. The system of claim 13, wherein the combustion area is on the outside of the supply chamber.

15. The system of claim 13, wherein the control valve is adjustable to regulate an amount of return flue gas to recycle with the outside air and gas mixture in the blower assembly.

16. The system of claim 15, wherein the outside air and gas mixture is drawn into the blower assembly via combustion intake for determining the amount of the return flue gas to recycle based on the oxygen content in the outside air and gas mixture.

17. The system of claim 13, wherein the non-recycled flue gas is exhausted outside of the gaseous fuel-air-flue gas burner via the exhaust pipe.

* * * * *